US007639128B2

(12) United States Patent
Kogan et al.

(10) Patent No.: US 7,639,128 B2
(45) Date of Patent: Dec. 29, 2009

(54) METHOD AND APPARATUS FOR REDUCING FALSE ALARMS IN A SECURITY SYSTEM

(75) Inventors: Eugene Kogan, Rochester, NY (US); Alan G. Hayter, Victor, NY (US); Dhanasekaran Nagarajan, Rochester, NY (US); Michael G. Marriam, West Henrietta, NY (US); Steve Markham, Rochester, NY (US)

(73) Assignee: Robert Bosch GmbH, Stuttgart (DE)

( * ) Notice: Subject to any disclaimer, the term of this patent is extended or adjusted under 35 U.S.C. 154(b) by 618 days.

(21) Appl. No.: 11/585,390

(22) Filed: Oct. 23, 2006

(65) Prior Publication Data

US 2008/0094203 A1 Apr. 24, 2008

(51) Int. Cl.
*G08B 29/00* (2006.01)

(52) U.S. Cl. ..... 340/506; 340/514; 340/515; 340/540; 340/541

(58) Field of Classification Search ..... 340/506, 340/514, 515, 540, 541
See application file for complete search history.

(56) References Cited

U.S. PATENT DOCUMENTS 5,828,300 A * 10/1998 Addy et al. ..... 340/539.16
6,288,639 B1 * 9/2001 Addy ..... 340/539.3
2002/0154009 A1 * 10/2002 McCuen et al. ..... 340/501

* cited by examiner

*Primary Examiner*—Toan N Pham
*Assistant Examiner*—Kerri McNally
(74) *Attorney, Agent, or Firm*—Sarah L. Taylor

(57) ABSTRACT

A method of operating a security system includes activating a security device and transmitting a first status report from the device in response to the activating step. A second status report is transmitted from the device after the first status report has been transmitted. The second status report is indicative of a status of an input of the security device. It is determined whether the first status report indicates a status different than the status indicated by the second status report. A third status report is transmitted from the device after the second status report has been transmitted. The third status report is indicative of the input of the security device being in an alarm condition and/or a trouble condition. Dependent upon whether the first status report indicates a status different than the status indicated by the second status report, an alarm and/or a trouble warning are issued in response to the third status report.

20 Claims, 7 Drawing Sheets

METHOD AND APPARATUS FOR REDUCING FALSE ALARMS IN A SECURITY SYSTEM

BACKGROUND OF THE INVENTION

1. Field of the Invention

The present invention relates to surveillance systems, and, more particularly, to the reduction of false alarms and false trouble conditions in surveillance systems.

2. Description of the Related Art

Surveillance systems, also known as security systems, are known to include security devices such as motion detectors, door sensors, window sensors, smoke detectors, relays, power supplies, etc., for monitoring a secured area of space. The security device may be either wireless or conventionally hard-wired.

Surveillance systems include a great variety of different installations and security devices. Using identically designed security devices in different installations can provide challenges. For example, security devices can have multiple alarm and trouble condition inputs which may be referred to herein as "sub-inputs." Not all of the sub-inputs are needed in every installation. Some of the sub-inputs remain unused and vulnerable to false alarms and false trouble conditions. False alarms are one of the biggest problems in the security industry.

A known method of preventing unused sub-inputs from creating false alarms or false trouble conditions includes installing special hardware, such as pull up resistors. Another known method is to begin to monitor the sub-input only when it becomes normal (e.g., not faulted). It is only after the sub-input becomes normal that the monitoring process begins. One problem with this particular solution is that the sub-input can accidentally normalize via noise or invalid communication. If the sub-input normalizes before the user is ready, then an alarm will be generated if the sub-input faults.

What is needed in the art is a security system in which unused sub-inputs are not liable to create false alarms or false trouble conditions.

SUMMARY OF THE INVENTION

The present invention provides a security system in which, in order to prevent false alarms, special masks are introduced for each sensor input. One mask is referred to as the alarm mask, and the other mask is referred to as the trouble mask. The sensor associated with an input can have multiple inputs. These may be referred to as "sub-inputs." For example, a sensor can have both a wired contact (voltage input) and a magnetic contact as an input, and therefore may have two sub-inputs.

When the system is installed, the installer may perform a system test activating all sub-inputs to ensure that they are monitored correctly. When in system test, every sub-input that is activated may be learned and subsequently monitored. Each change on the learned sub-input may thereby create a trouble condition or alarm. Sub-inputs that were not learned may be ignored. The alarm and trouble masks enable the appropriate sub-input to be ignored, which in turn reduces the potential for false alarms and false trouble conditions.

The invention comprises, in one form thereof, a method of operating a security system including activating a security device and transmitting a first status report from the device in response to the activating step. A second status report is transmitted from the device after the first status report has been transmitted. The second status report is indicative of a status of an input of the security device. It is determined whether the first status report indicates a status different than the status indicated by the second status report. A third status report is transmitted from the device after the second status report has been transmitted. The third status report is indicative of the input of the security device being in an alarm condition and/or a trouble condition. Dependent upon whether the first status report indicates a status different than the status indicated by the second status report, an alarm and/or a trouble warning are issued in response to the third status report.

The invention comprises, in another form thereof, a security system including at least one security device having an input. The security device transmits a first status report in response to being activated, and transmits a second status report after the first status report has been transmitted. The second status report is indicative of a status of the input of the security device. The security device transmits a third status report after the second status report has been transmitted. The third status report is indicative of the input of the security device being in an alarm condition and/or a trouble condition. A system controller receives the first, second and third status reports and determines whether the first status report indicates a status different than the status indicated by the second status report. The system controller issues an alarm and/or a trouble warning in response to the third status report only if the first status report indicates a status different than the status indicated by the second status report.

The invention comprises, in yet another form thereof, a method of operating a security system, including activating a security device and transmitting a first status report from the device in response to the activating step. The first status report indicates a fault condition of an input of the security device regardless of whether the fault condition exists. A second status report is transmitted from the device after the first status report has been transmitted. The second status report is indicative of an actual status of the input of the security device. A third status report is transmitted from the device after the second status report has been transmitted. The third status report is indicative of the input of the security device being in an actual fault condition. A fault warning is issued in response to the third status report only if the second status report is indicative of an absence of a fault condition of the input of the security device.

An advantage of the present invention is that false alarms and false trouble conditions due to unused inputs of security devices may be avoided.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
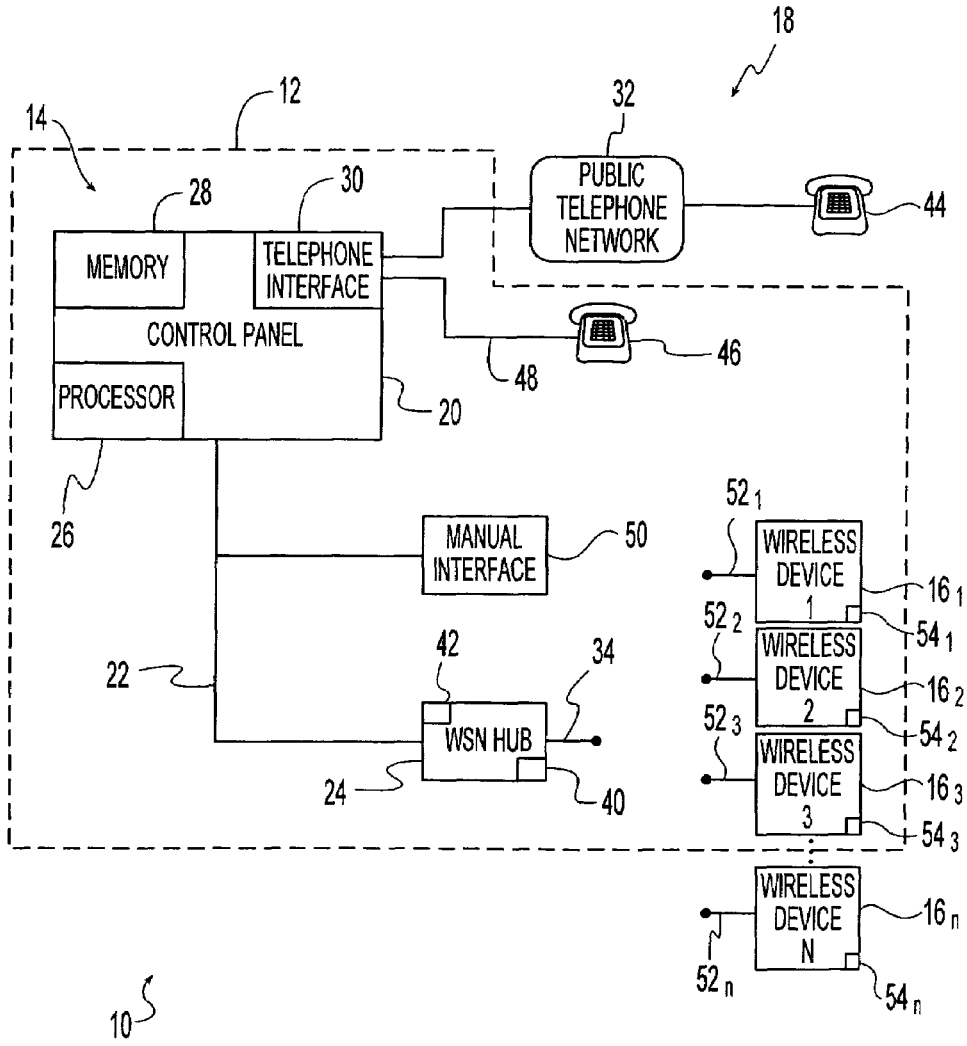
FIG. 1 is a block diagram of one embodiment of a security system of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, wireless security devices $\mathbf{16}_1$ through $\mathbf{16}_n$, and an installer interface 18.

System controller 14 includes a control device in the form of a control panel 20 electrically connected via an option bus 22 to a wireless sensor network (WSN) hub 24, which also may be referred to as a "wLSN hub". Control panel 20 may include a processor 26, a memory device 28 and a telephone interface 30. Processor 26 may coordinate communication with the various system components including installer interface 18 and WSN hub 24. Memory 28 may include software for interpreting signals from wireless devices 16 and installer interface 18, and deciding based thereon whether to transmit an alarm signal from control panel 20. Memory 28 may also serve as a database for wireless devices 16. The alarm signal may be used to activate an audible alarm (not shown) within building 12, or to notify a central station receiver (CSR) (not shown) such as a security company, fire station, or police station, for example, via public telephone network 32. Memory 28 may also store identification information and configuration data for wireless devices 16, as described in more detail below.

WSN hub 24 may include an antenna element 34 for transmitting and receiving air-borne signals, such as radio frequency signals. The radio frequency signals may be received by and transmitted from, i.e., exchanged with, wireless devices 16. Information from wireless devices 16 may be passed by WSN hub 24 to control panel 20 via option bus 22. Control panel 20 may pass information to WSN hub 24 via option bus 22 for transmission to wireless devices 16 as necessary. WSN hub 24 may include a processor 40 and memory 42 for storing software, identification information associated with wireless devices 16, and configuration data associated with wireless devices 16.

Installer interface 18 may include an outside communication device 44, such as a cell phone, standard phone, or computer equipped with a modem; a house phone 46, which may be hard-wired to telephone interface 30 via a telephone line 48; and a manual interface 50, which may be in the form of a keypad. Manual interface 50 may be in communication with control panel 20 and WSN hub 24 via option bus 22. Thus, installer interface 18 may be in communication with system controller 14 via public telephone network 32, telephone line 48, and/or option bus 22. Installer interfaces including Ethernet or a networked connection are also possible.

Wireless devices 16 may be in the form of any number or combination of window sensors, door sensors, glass break sensors, inertia sensors, motion detectors, smoke detectors, panic devices, gas detectors and keyfobs, for example. Window sensors and door sensors may detect the opening and/or closing of a corresponding window or door, respectively. Panic devices may be in the form of devices that human users keep on their person, and that are to be used to summon help in an emergency situation. Gas detectors may sense the presence of a harmful gas such as carbon monoxide, or carbon dioxide. A keyfob may be used to arm or disarm security system 10, and is another device that a user may possibly keep on his person. Each wireless device 16 includes a respective antenna element 52 for transmitting and receiving air-borne signals, such as radio frequency signals. The radio frequency signals may be received by and transmitted from, i.e., exchanged with, WSN hub 24. Wireless devices $\mathbf{16}_1$, $\mathbf{16}_2$ and $\mathbf{16}_3$ are indicated in FIG. 1 as being disposed inside building 12, and wireless device $\mathbf{16}_n$ is indicated in FIG. 1 as being disposed outside building 12. However, any number of wireless devices 16 may be disposed within building 12, and any number of wireless devices 16 may be disposed outside building 12. Types of wireless devices that may be permanently or temporarily disposed outside of building 12 during installation may include motion detectors, panic devices and keyfobs.

During installation, some types of wireless devices 16 may be mounted or hung in a permanent or semi-permanent desired location. Examples of such types of wireless devices 16 may include window sensors, door sensors, glass break sensors, inertia sensors, motion detectors, smoke detectors, and gas detectors. Other types of wireless devices 16 may be disposed in temporary locations during installation, or may even be in motion, such as a panic device or keyfob being carried on a user's person.

To begin the installation, a human installer positioned within building 12 may access installer interface 18 such as by picking up the receiver on house phone 46, or by actuating keys on manual interface 50. As an alternative, or in addition, to house phone 46, there may be a modem-equipped computer (not shown) within building 12 that is attached to telephone line 48 and that may be used as an installer interface. It is also possible for a human installer disposed outside of building 12 to remotely communicate with system 10 by calling a dedicated telephone number associated with security system 10. The calling of the dedicated telephone number may be performed via public telephone network 32 and an outside telecommunication device 44, which is illustrated as a standard telephone in FIG. 1, but may alternatively be in the form of a cell phone or a computer equipped with a modem. The dedicated telephone number associated with security system 10 may be the same number that is used by house phone 46 for voice communication. Regardless of which of outside telecommunication device 44, house phone 46, and manual interface 50 is used, the installer may follow system prompts to thereby cause system 10 to enter a wireless maintenance mode of operation.

Instead of the procedures described in the above paragraph, an installer may press a test button (not shown) on control panel 20 in order to implement an automatic self-test procedure. Generally, by the installer pressing a single test button, the system may be taken directly to a wireless mode in which the installer is bypassed and the security devices are learned and automatically configured. In a specific embodiment, pressing the test button for two seconds and releasing it may cause the panel to run through a test sequence. After some tests are run, the human installer running the test may be asked to press the '1' button on a keypad (not shown) for a point walk test or press '5' to skip it. If the installer presses '1', and the system has a wLSN hub connected that has not been initialized, then the panel may start the discovery/configuration/test process with no further input until the devices are ready to be activated.

Once the wireless maintenance mode has been entered, the installer may make appropriate selections via installer interface 18 in order to transmit an installation initiation signal directing WSN hub 24 to go into a discover mode. If the user is disposed outside of structure 12, he may remotely transmit the installation initiation signal via a cell phone, for example. In the discover mode, hub 24 may be instructed to "discover" wireless devices, such as wireless devices 16, that need to be installed in system 10. Discovering a wireless device may include receiving, assigning, or otherwise ascertaining unique identification information and configuration data for that device, such as an identification number, a type of the device, time periods when the device is on and off, supervision intervals (i.e., how often the device should report its status), operational parameters based upon the regulations in which the system is to operate, and/or a function of the device.

In a learn mode of operation, system controller 14 issues an air-borne signal requesting that each wireless device 16 that receives the request reply with an identification number and the type of the device. System controller 14 may store each identification number and its associated type in memory 28 for further reference. The identification number may be any string of alphanumeric characters and/or bits that uniquely identifies the wireless device with which the identification information is associated. This identification number may be included within any signal transmitted from a wireless device, both during installation and during surveillance operation of system 10, in order to identify which of wireless devices 16 that the signal is being transmitted from.

The device type information may specify whether the wireless device is a window sensor, door sensor, glass break sensor, inertia sensor, motion detector, smoke detector, gas detector, panic device or keyfob, for example. The device type information may further break down these categories by subcategories such as indoor or outdoor motion detector, garage door or front door sensor, carbon monoxide or carbon dioxide, etc.

Certain assumptions about how each wireless device should be configured can be made based upon the type of the wireless device. For example, if a wireless device is a smoke detector type, then it may be assumed that the wireless device should remain ON continually. It may be further assumed that the wireless device should have a supervision interval of about two hundred seconds. That is, the smoke detector should report its status at least every two hundred seconds, as required by United States regulations. As another example, if a wireless device is an interior motion detector type, then it may be assumed that the wireless device should be ON only after a user has entered a valid arming code into manual interface 50 and a door sensor detects the opening and closing of an exterior door within a certain time period thereafter. It also may be assumed that the wireless device should have a supervision interval of about four hours. That is, the interior motion detector should report its status at least every four hours. Of course, if the interior motion detector were to detect motion within that four hour period, then the detector would report its new status immediately, or as soon as the detection of motion could be confirmed.

The function information may include the conditions under which control panel 20 should transmit an alarm signal, or take some other action, in response to the wireless device transmitting a notification signal during surveillance operation. The notification signal from the wireless device may indicate, in the case of a panic device or keyfob, that a button on the panic device or keyfob is being actuated, or may indicate that the wireless device is sensing motion, sound, smoke, gas, the opening of a door/window, etc. For example, if a door sensor is on a door that can be unlocked from outside building 12 with a key, then it may be desirable to transmit an alarm signal only under the condition that an arm/disarm code has not been entered on manual interface 50 within one minute after the door is opened. Thus, a resident of building 12 returning from a trip would have a chance to disarm system 10 after unlocking the door. Conversely, if a door sensor is on a door that cannot be unlocked from outside building 12 with a key, then it may be desirable to transmit an alarm signal under all conditions in which system 10 is armed and the door has been opened. Other examples of the various functions of security devices are known in the art, and thus are not discussed in further detail herein.

When system 10 is in the discover mode, a human installer may visit each wireless security device and perform some type of actuation that serves to activate the device. For example, the installer may press a button on each device to thereby activate the device. The manual activation of the devices causes each device to respond by transmitting an air-borne signal including its unique identifier. The wireless device may also report the state that it is currently in. For example, a motion sensor may report that it is detecting motion, which may be due to either the movements of the human installer or software code within the sensor that directs the sensor to report motion automatically upon activation by the installer. As another example, a smoke detector would likely be designed to report that it detects the presence of smoke upon human activation regardless of whether smoke is actually present at the time of activation.

Upon receiving the unique identifier of a device, system controller 14 may look up the device's type, which may be stored in memory 28 or may be accessed on-line via the internet. Based on the device type, system controller 14 may make some assumptions about how the device should be configured, as discussed above. System controller 14 then may monitor the device dependent upon the type of the device. As used herein, the term "monitoring" may include supervising the security devices, such as by sending instruction signals to the security devices. The term "monitoring" may also include processing reporting signals from the security devices and deciding what action should be taken in response to the reporting signals. For example, system controller 14 may cause an alarm to issue depending upon both a reported change of status of the security device, and how the device has been configured.

Instruction signals transmitted from system controller 14 to devices 16 may generally specify the configuration of the devices. That is, the instruction signals may instruct the devices how often to report status (i.e., the supervision interval), and during what time periods to be in an active state (i.e., the duty cycle).

Following the discovery phase, hub 24 may give control panel 20 the identification and type information from all wireless devices 16 that transmit such information in response to being requested therefor. These discovered wireless devices may be respectively assigned the next available panel zone numbers in addition to the unique identifiers that may be provided by the devices themselves. System controller 14 may assign each wireless device a respective zone number for reporting purposes (e.g., device 6 is in alarm). This number may be used in communication within and between control panel 20 and hub 24, but may not be communicated to the device to which the number has been assigned.

Once the discover phase is complete, and control panel 20 has received its full capacity of identification information, the identification information may be sorted and zone numbers may be assigned by control panel 20. Zone numbers may be assigned based on groups of wireless device types. For example, all the window sensors that respond may be assigned consecutive zone numbers beginning with the first available zone number that is available. Control panel 20 may then assign zone numbers to the motion detectors, picking up where the assignment of zone numbers to the window sensors left off. Next, zone numbers may be assigned to smoke detectors, and so on until all devices that responded are assigned a zone number.

Once a wireless device has transmitted its unique identifier and its type information, once the device has been activated, and once system controller 14 has transmitted instruction signals to the device based upon its type, testing may be completed upon the device transmitting a report indicating that its state has changed since its initially reported state. For example, a motion detector that initially reported the presence of motion (due to movements of the human installer or automatically by design) may time out after the installer has walked out of range. After timing out, the motion detector may report that motion is no longer present. Having received reports of each of two possible statuses (motion and no motion) from the motion detector, the system controller's testing of the motion detector is complete. As another example, a smoke detector that initially reported the presence of smoke (automatically by design) may time out a predetermined time period after the installer has released an activation button. After timing out, the smoke detector may report that smoke is no longer present. Having received reports of each of two possible statuses (smoke and no smoke) from the smoke detector, the system controller's testing of the smoke detector is complete.

Upon the completion of testing, system 10 may enter an operational mode in which system 10 performs its intended function of providing surveillance. In the operational mode, wireless devices 16 continue to report their statuses according to and dependent upon their configurations, and system controller 14 continues to monitor devices 16 according to and dependent upon the configurations of devices 16.

Each wireless device 16 may be provided with an LED 54 that may light up or flash to indicate to the installer that the wireless device is transmitting, or has recently transmitted, some type of signal. If the LED does not light up or flash at the desired device, then the installer may need to perform some troubleshooting. For example, the installer may check the battery (not shown) of the wireless device or replace the wireless device with another one.

There may be an occasion when the default configuration that control system 14 has assigned to a wireless device 16 needs to be changed to suit a particular application. In order to modify the configuration of a wireless device, a user may access manual interface 50 and key in replacement configuration data for the wireless device.

Figure 2:
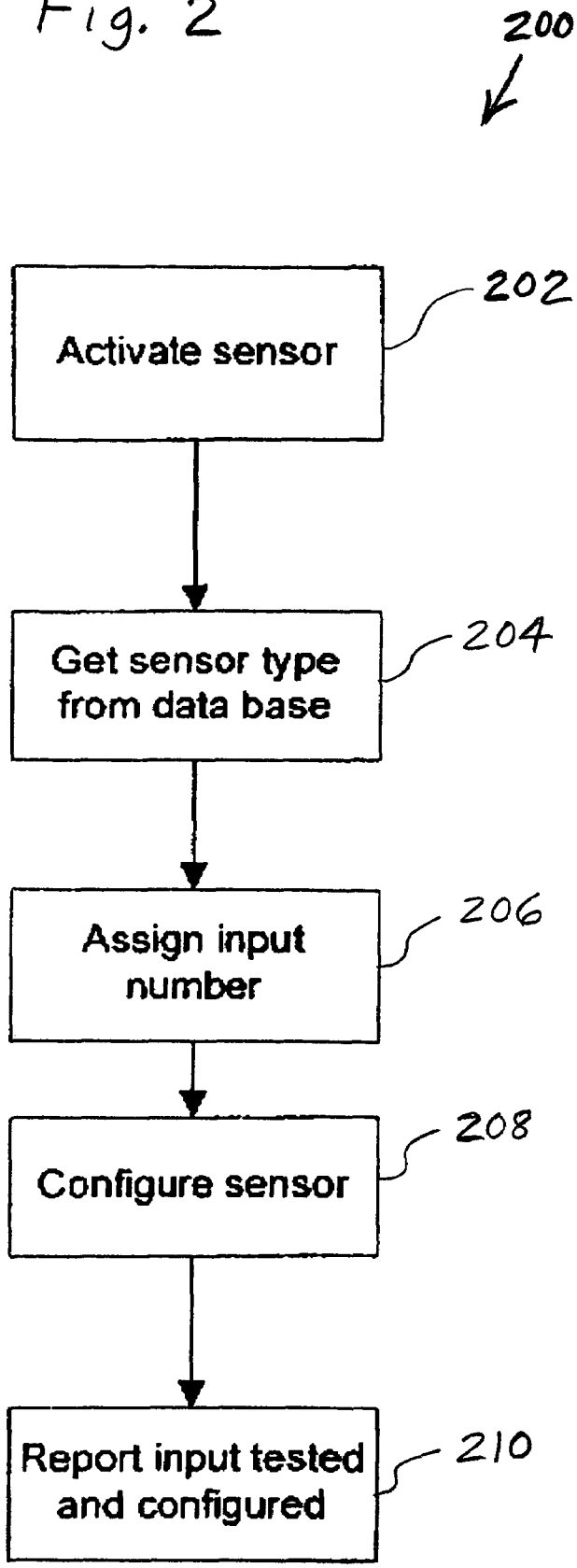
FIG. 2 is a flow chart of one embodiment of a security system installation method of the present invention.

One embodiment of a method 200 of the present invention is illustrated in FIG. 2. In a first step 202, a sensor is activated. For example, a human installer may activate a smoke detector by pressing a test button on the smoke detector, thereby causing the smoke detector to transmit a code to the system controller indicating the smoke detector's unique identification number. In a second step 204, the system controller uses the received code to retrieve the sensor type (smoke detector) from the sensor database in memory 28. Next, in step 206, an input number, or zone number, is assigned by the system controller to the reporting sensor. The system controller may use this input number to identify which of the wireless devices that a particular report has been received from. In step 208 the sensor is configured. For example, system controller may inform the sensor with regard to how frequently the sensor should report its status, during what time periods the sensor should be actively sensing, and which country's operational regulations to follow. The configuration may be dependent upon the type of sensor. In a final step 210, control panel 20 may report to hub 24 that the sensor (input) has been tested and configured. Testing may be completed upon the sensor timing out after activation and reporting the second of its two possible states. At this point, the system controller has confirmed that the sensor is capable of reporting both of its states.

Figure 3:
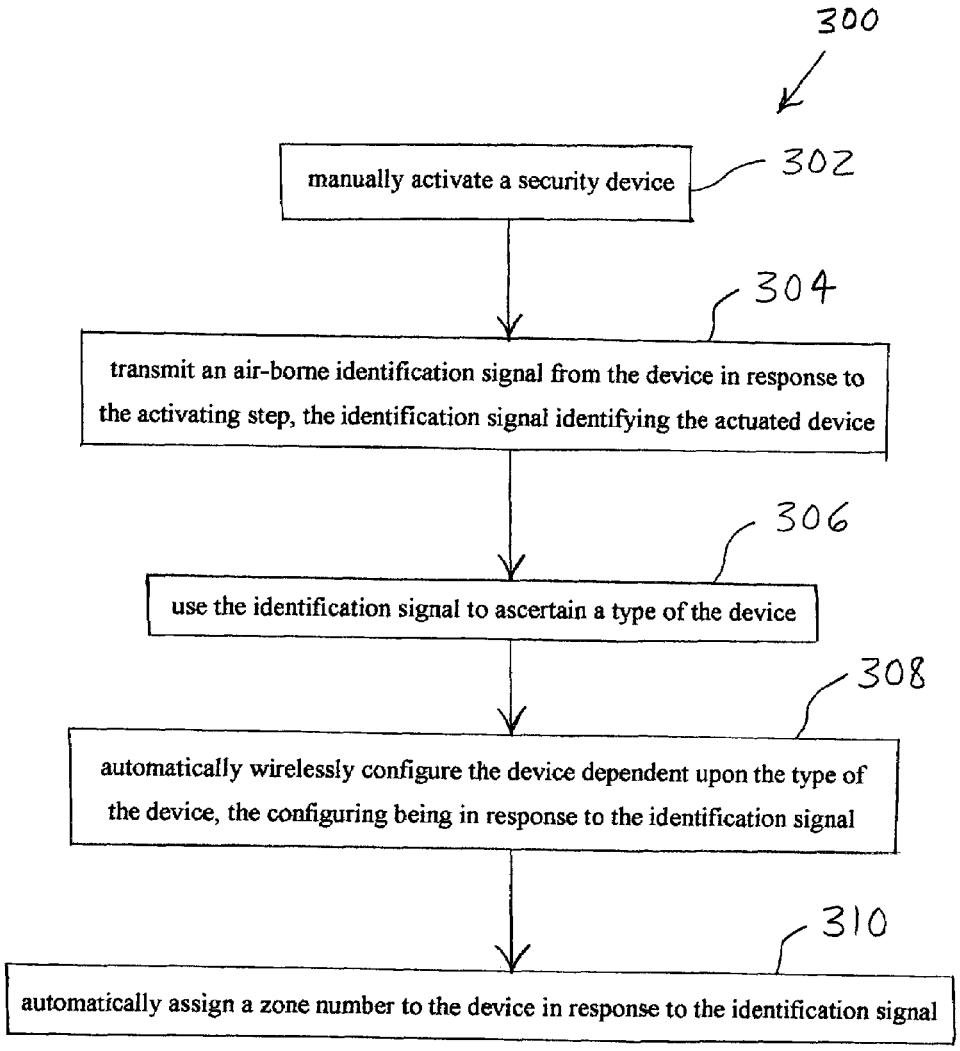
FIG. 3 is a flow chart of another embodiment of a security system installation method of the present invention.

FIG. 3 illustrates another embodiment of a method 300 of the present invention for installing a security system. In a first step 302, a security device is manually activated. For example, a human installer may press a button on a door sensor in order to activate the door sensor. In a next step 304, an air-borne identification signal is transmitted from the device in response to the activating step. The identification signal identifies the actuated device. More particularly, in response to having its button pushed, the door sensor may transmit a radio frequency signal that uniquely identifies the door sensor as the wireless device that has been activated. Next, in step 306, the identification signal is used to ascertain a type of the device. For example, the system controller may use the unique identification number in referencing a look up table in memory 28 that associates the number with the type of the device, i.e., a door sensor. In a next step 308, the device is automatically wirelessly configured dependent upon the type of the device, the configuring being in response to the identification signal. For instance, the system controller may wirelessly transmit configuration data to the sensor depending upon its type. As a specific example, if the device is of the smoke detector type, then the device may be configured to have a relatively short supervision interval, such as 200 seconds. If, however, the device is an interior motion detector type, then the device may be configured to have a relatively lengthy supervision interval, such as four hours. Configuration of the device's duty cycle (i.e., its ON times) may also depend upon the type of the device. For example, a smoke detector may remain ON continuously, while an interior motion detector may be ON only while people have vacated the building. These configuration parameters may be transmitted from the system controller (specifically, the hub) to the wireless devices via air-borne signals. Thus, aspects of monitoring, such as the transmitted configuration data and how often the system controller receives reporting signals, may be dependent upon the sensor's type. In a final step 310, a zone number is automatically assigned to the device in response to the identification signal. A zone number may be used internally by the system controller to compartmentalize communications with a particular device. Devices of the same type may be assigned consecutive zone numbers.

Figure 4:
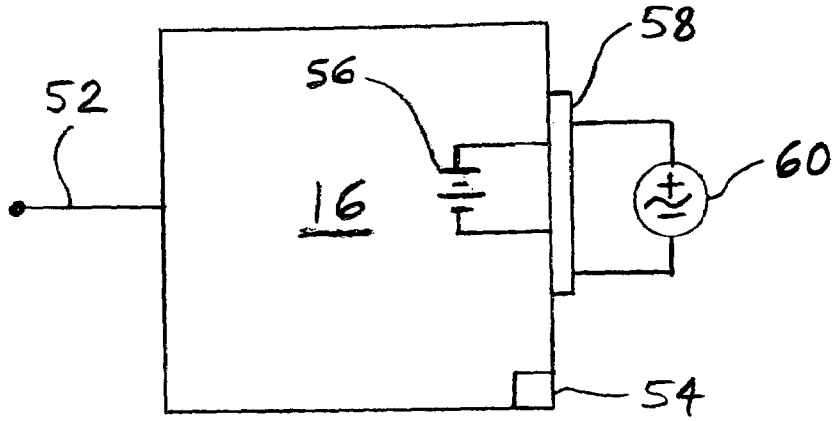
FIG. 4 is one embodiment of a wireless device suitable for use in the security system of FIG. 1.

It is possible for a wireless device to have more than two possible states. For example, an exemplary wireless device 16 is shown in FIG. 4 as having a battery 56 as a back up power source. Device 16 also includes a DC power supply 58 that may be plugged into a power source in the form of a conventional wall receptacle 60. The use of DC power supply 58 may be desirable for a device 16 in the form of an alarm siren, for example. In other applications, battery 56 is the primary power source and no DC power supply is included. Because DC power supply 58 is an option (i.e., is not standard equipment), its presence/absence comprises a sub-input of device 16 in addition to the other sub-input comprised by whether the alarm siren is sounding an alarm or not. A DC power supply may also be particularly appropriate for application to a relay type wireless device that controls the application of power to another security device. It is also possible, in other embodiments, for a trickle charger to be used in place of a DC power supply. Such a trickle charger would continually recharge a rechargeable version of battery 56.

During testing, an alarm siren type of device may initially report that it is sounding an alarm before timing out and then reporting its actual state of not sounding an alarm. Thus, the system controller has received reports in each of the two states, and that aspect of testing is complete. If power supply 58 is present and plugged in during testing, then device 16 may initially report as a sub-input that the voltage from power supply 58 is absent. After the short time-out period, device 16 may report that the voltage from power supply 58 is present, and thus that aspect of testing is also complete. However, if power supply 58 is absent during testing, then device 16 may report as a sub-input that the voltage from power supply 58 is absent, and may continue to report the absence after the time-out period. Because system controller 14 does not receive each of two possible states of the sub-input of power supply presence/absence, testing of this sub-input is not completed. If a source of a sub-input such as a power supply is not present in a wireless device, then it may not be possible for an installer to activate that sub-input during testing.

In the case where power supply 58 is present and testing has been completed, any subsequent loss of power from power supply 58 may be reported by device 16 as a trouble condition that should be investigated, and system controller 14 may treat it as a trouble condition. For example, system controller 14 may energize a red warning light on control panel 20, and/or periodically emit an audible beep, to thereby notify the user of the trouble. In the case where power supply 58 is absent and testing has not been completed, device 16 may continue to report the absence of power from a power supply as a trouble condition that should be investigated. This may be a problem if system controller were to respond by notifying the user of trouble when in fact there is no trouble because no power supply was ever installed. However, according to the invention, a mask is applied to this power supply present/absent sub-input because testing of the sub-input was not completed. As a result of the mask, system controller 14 may ignore subsequent reports of a missing power supply and not treat it as a trouble condition.

Figure 5:
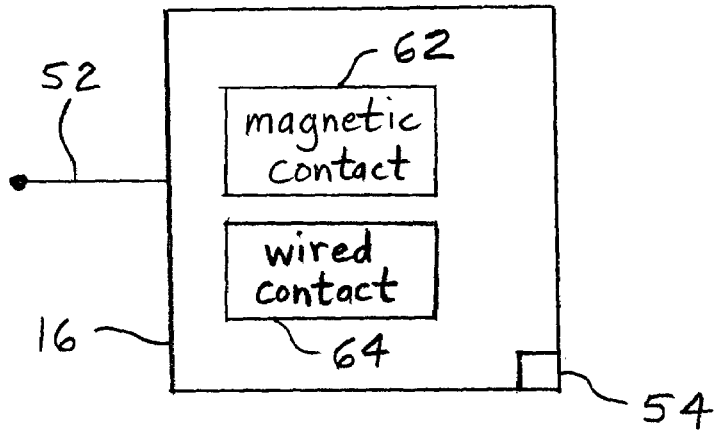
FIG. 5 is another embodiment of a wireless device suitable for use in the security system of FIG. 1.
Figure 6:
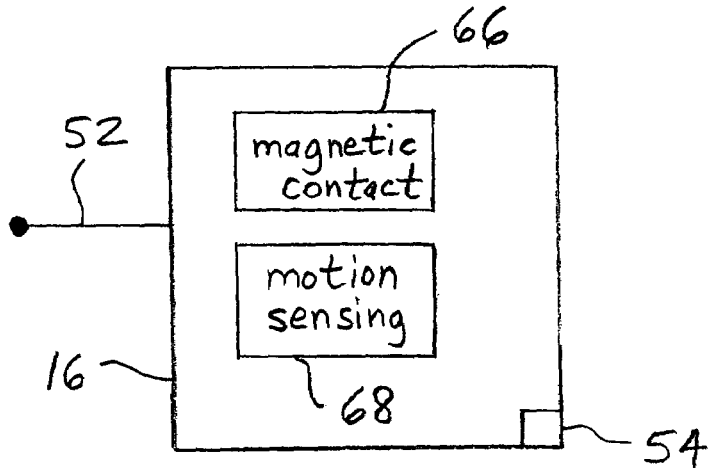
FIG. 6 is yet another embodiment of a wireless device suitable for use in the security system of FIG. 1.

Other embodiments of wireless devices 16 that have multiple sub-inputs are illustrated in FIGS. 5 and 6. Device 16 in FIG. 5 may be a door/window sensor that is capable of detecting whether the door/window is open or closed by employment of a magnetic contact 62 and/or a wired contact 64. The presence of a magnetic field or a voltage may be sensed by contacts 62, 64, respectively, in order to detect whether a window/door is open or closed. Only one of the two contacts may be required for most applications, although both contacts may be employed when security needs are particularly crucial. Device 16 may report the status of both magnetic contact 62 and wired contact 64, regardless of whether both contacts are actually present. Upon activation during testing, device 16 may report that both contacts 62, 64 are open, either automatically or due to the door/window actually being open. After the door/window is closed by the installer, or after a time-out period if the door/window is already closed, device 16 may report that whichever one(s) of contacts are actually present and are actually closed are indeed closed. If either of contacts 62, 64 are not present in device 16, then device continues to report that the missing contact is open. Thus, any missing contact does not have a status reported in both states, and does not have its testing completed.

The open state of the missing contact may be reported by device 16 as an alarm condition that should be responded to by sounding a siren alarm. Because the door/window is not actually open, sounding the alarm would be a nuisance to the user, to neighbors, and to the police who might respond to the alarm. However, according to the invention, a mask is applied to whichever one(s) of the magnetic contact and wired contact sub-inputs is not fully tested. System controller 14 may ignore subsequent reports of an open window/door from any sub-input contact to which a mask has been applied and not treat it as an alarm condition.

Device 16 in FIG. 6 may be an inertia type sensor that is capable of detecting whether the glass of a window has been broken, for example, by employment of a magnetic contact 66 and/or a motion sensing module 68. Only one of magnetic contact 66 and motion sensing module 68 may be required for most applications, although both may be employed when security needs are particularly crucial. The system controller's treatment of reports from these two sub-inputs in deciding whether to issue an alarm may be substantially similar to the treatment described above with reference to FIG. 5, an thus is not described in detail herein in order to avoid needless repetition.

Figure 7:
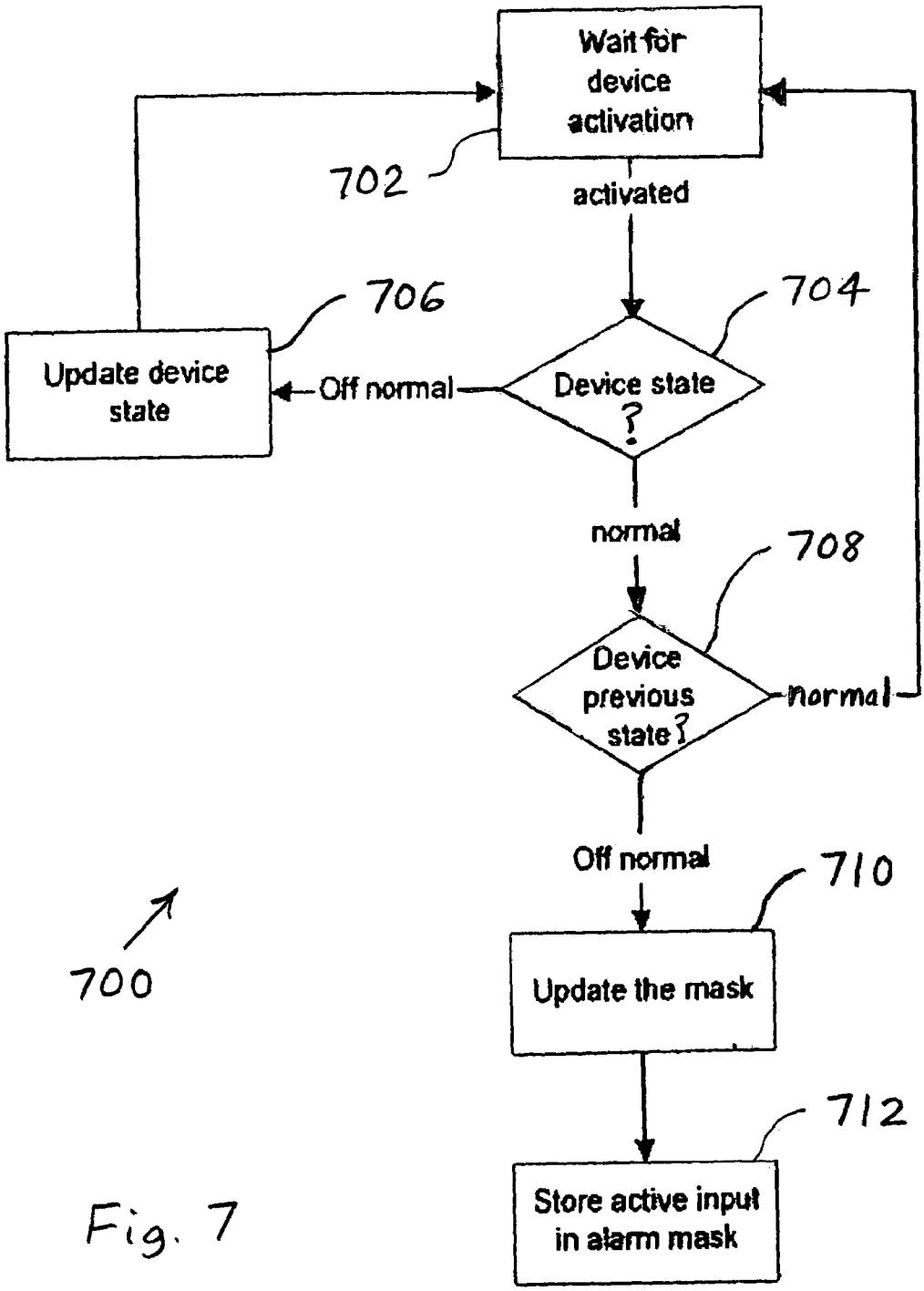
FIG. 7 is a flow chart of one embodiment of a method of the present invention for reducing false alarms in a security system.

One embodiment of a method 700 of the present invention for reducing false alarms and trouble reports in a security system, particularly learning an alarm mask, is illustrated in FIG. 7. In a first step 702, a wireless device in the security system is activated. For example, an installer may press a button on a wireless smoke detector in order to activate the smoke detector. Next, in step 704, a device state is determined. The smoke detector may have two sub-inputs, each of which has its own state. A first sub-input may be whether the presence of smoke is detected, and a second sub-input may be whether the presence of a power supply voltage is detected. Upon activation, the smoke detector may automatically report the presence of smoke, which may be designated as "Off normal" in the flow chart of FIG. 7, and the device state is updated as such in step 706. Operation returns to step 702, and after a time-out period has passed, the smoke detector report may revert to its previous state before activation, which may be referred to as "normal" (smoke absent). This reversion back to the normal state functions, in step 702, as a second activation. At this point, both states of the smoke detector (smoke present/smoke absent) have been reported by the smoke detector and testing is complete. Thus, in step 704, the device state is "normal" and operation continues to step 708. If the device responded with an "Off normal" report after the initial activation, then the previous state is determined to be "Off normal" in step 708 and operation continues to step 710. The mask for this sub-input of smoke presence is updated, i.e., the mask for this sub-input is removed, and the smoke presence is stored in memory 28 as an active sub-input in the alarm mask (step 712). Thus, any subsequent reports of the presence of smoke will be treated by system controller 14 as a valid alarm condition. If, however, the device did not respond with an "Off normal" report after the initial activation, then operation proceeds from step 704 directly to step 708 without ever passing through step 706. This may be the case if the smoke detector is malfunctioning in some way. In step 708, the previous state is determined as "normal" and operation reverts back to step 702. Thus, the mask is not removed from the sub-input of smoke presence, and operation may continue in an endless loop including steps 702, 704, 708 until the smoke detector properly responds with an "Off normal" report in response to being manually activated.

As for the second sub-input of the presence of a power supply, assume for purposes of illustration that no power supply is present. Upon activation, the smoke detector may report the state (step 704) of absence of external voltage, which may be referred to and updated as "off normal" (step 706). Because the smoke detector has not reported the second state (power supply voltage present) for this sub-input, testing is not completed, and any subsequent reports of the lack of power supply voltage from the smoke detector may be ignored by system controller 14. Operation then returns to step 702, where another activation is awaited in the event that an external power supply has been added.

Figure 8:
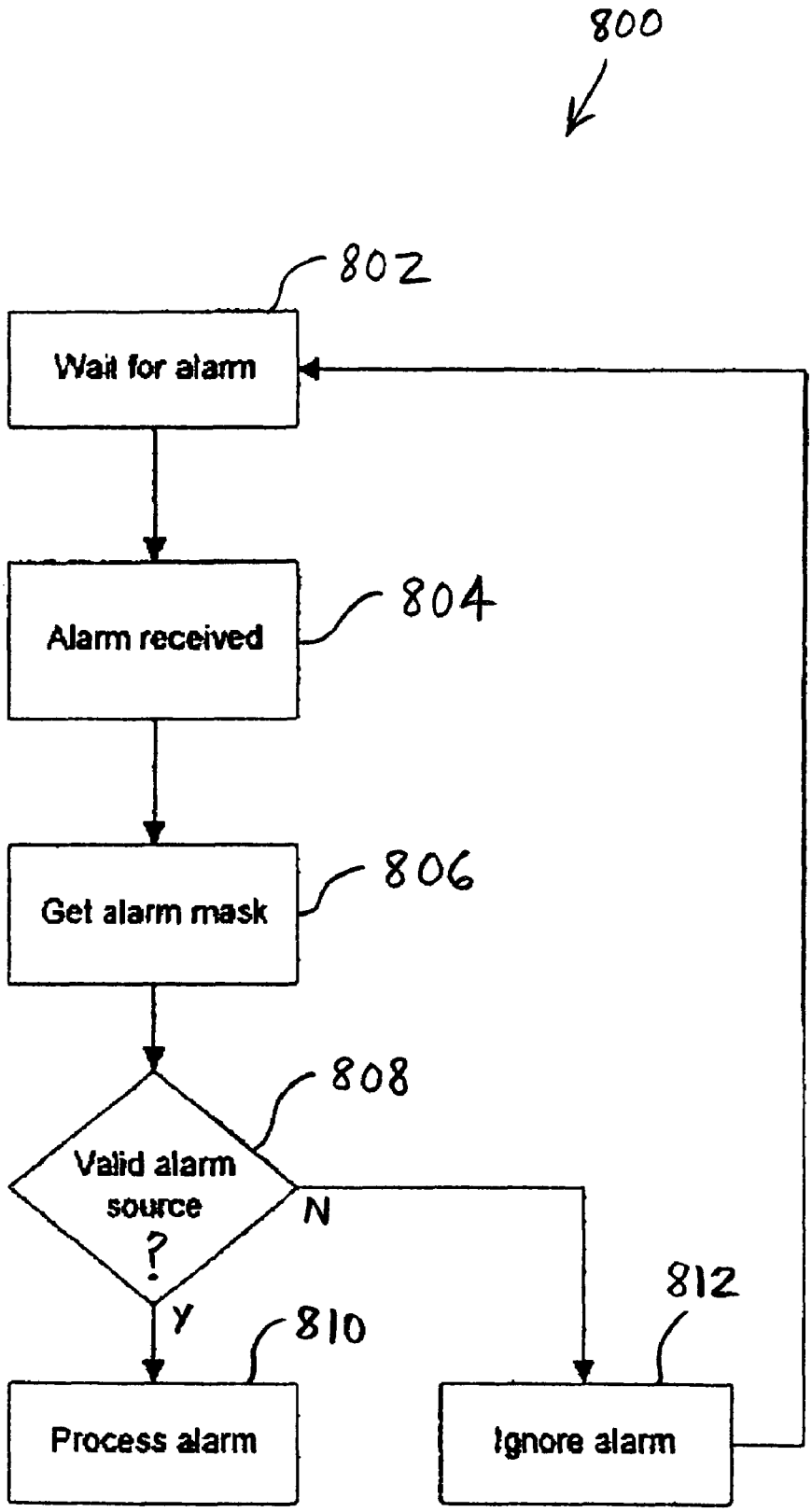
FIG. 8 is a flow chart of another embodiment of a method of the present invention for reducing false alarms in a security system.

Another embodiment of a method 800 of the present invention for reducing false alarms and trouble reports in a security system, particularly processing a report of an alarm condition, is illustrated in FIG. 8. Method 800 may be a continuation of method 700, and thus may be described herein with reference thereto. In a first step 802, a report of an alarm condition is awaited. In step 804, a report of an alarm condition is received, such as from the smoke detector referenced with respect to method 700 above. That is, the smoke alarm may report the presence of smoke. Next, in step 806, the alarm mask is obtained, such as from memory 28. The alarm mask may be used to determine whether the smoke detector is a valid alarm source in step 808. If the smoke detection sub-input of the smoke detector has been fully tested, as described above with reference to method 700, then the alarm is processed (step 810). That is, system controller 14 may cause an alarm siren to sound. If, in step 810, the alarm source has not been tested, and thus a mask is applied to the alarm source, then system controller 14 may not cause an alarm siren to sound. That is, the alarm may be ignored (step 812).

Method 800 has been described as applying to the processing of the report of an alarm condition. However, method 800 may be equally applicable to the processing of the report of a trouble condition. For example, a trouble condition report may be received from the smoke detector discussed above with reference to method 700, wherein the report indicates that no external voltage is present. In a step analogous to step 808, a trouble condition mask may be used to determine whether the detection of a power supply is a valid trouble condition source. If, as described above with reference to method 700, the power supply detection sub-input of the smoke detector has not been fully tested, and thus a mask is applied to the trouble condition source, then system controller 14 may not cause a trouble condition to be indicated. That is, the trouble condition may be ignored in a step analogous to step 812. Conversely, if the power supply detection sub-input of the smoke detector has been fully tested, then the trouble condition is processed in a step analogous to step 810. That is, system controller 14 may cause a trouble light to be energized, and/or may cause an audible tone to be emitted periodically.

Figure 9:
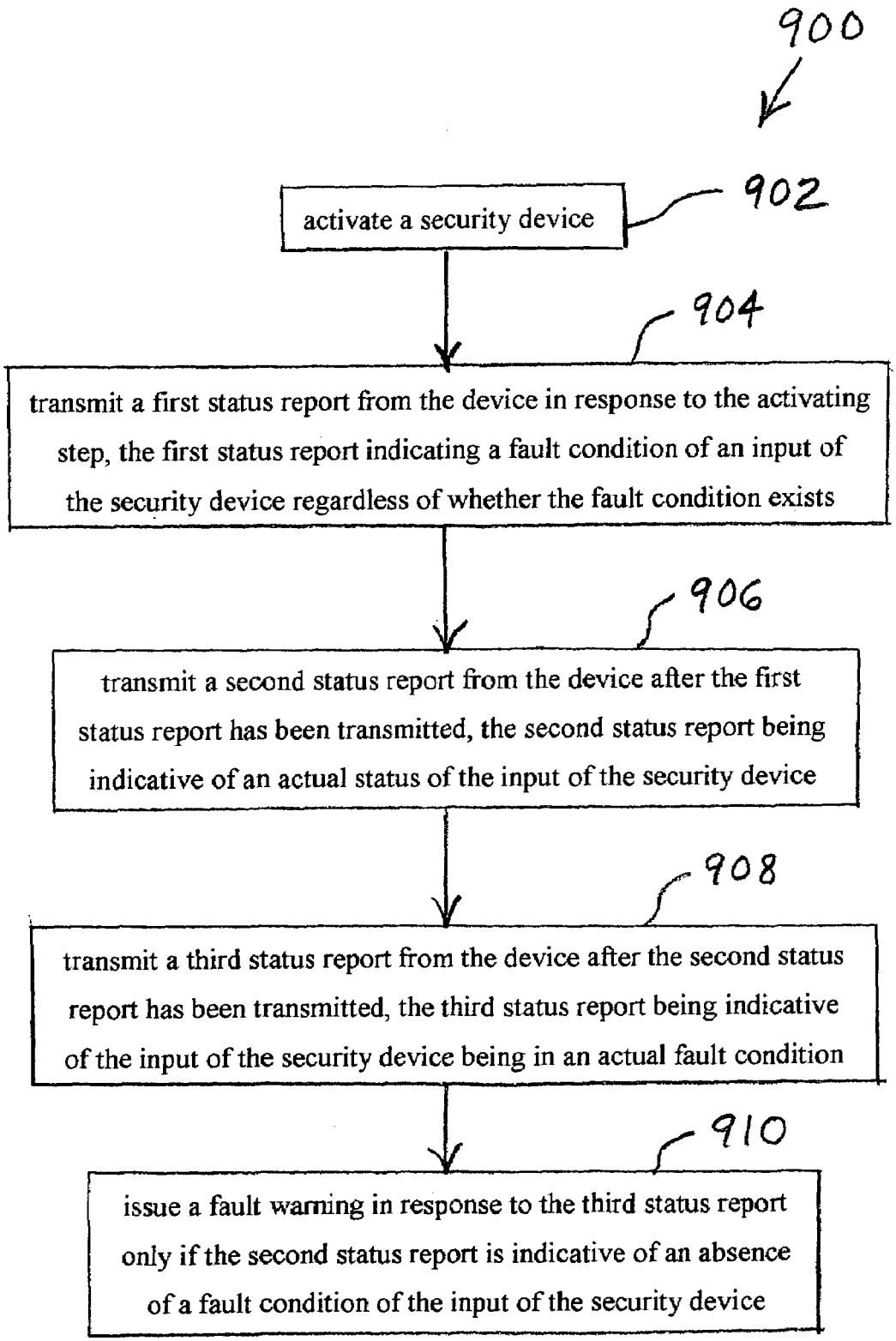
FIG. 9 is a flow chart of yet another embodiment of a method of the present invention for reducing false alarms in a security system.

Yet another embodiment of a method 900 of the present invention for reducing false alarms and trouble reports in a security system, is illustrated in FIG. 9. In a first step 902, a security device, such as a smoke detector, is activated, such as by pressing a button. Next, in step 904, a first status report is transmitted from the device in response to the activating step, the first status report indicating a fault condition of an input of the security device regardless of whether the fault condition exists. Either an alarm condition or a trouble condition may be regarded as a fault condition. For example, a status report may be transmitted from the smoke detector in response to the activation. The status report may indicate the presence of smoke, regardless of whether smoke actually is present. In a next step 906, a second status report is transmitted from the device after the first status report has been transmitted, the second status report being indicative of an actual status of the input of the security device. For instance, after a suitable time-out period, the smoke detector may send another report. This second report may indicate whether smoke is in reality present. The first and second status reports may be transmitted in a testing mode, and a third status report, as well as numerous subsequent status reports, may be transmitted in an operational mode. In step 908, a third status report may be transmitted from the device after the second status report has been transmitted, the third status report being indicative of the input of the security device being in an actual fault condition. That is, the smoke detector may at some later point send another status report indicating the presence of smoke. In order to determine the credibility of this indication of smoke, it may be determined whether the first status report indicates a status different than the status indicated by the second status report. Particularly, if in step 906 the smoke detector indicated an absence of smoke, then the smoke detector has been fully tested, and the third status report may be regarded as credible. However, if in step 906 the smoke detector continued to indicate an absence of smoke in the second status report, it may indicate that the smoke detector is not operating correctly or its smoke detecting features are missing entirely. Thus, the third status report in step 908 which continues to indicate the presence of a fault condition (smoke) may not be credible. Thus, in final step 910, a fault warning is issued in response to the third status report only if the second status report is indicative of an absence of a fault condition of the input of the security device. That is, unless the smoke detector has previously indicated the absence of smoke, then the indication of smoke in the third status report may not be credible, and thus may be ignored.

In order to simplify the description, method 900 has been described as applying to one input of a security device. However, it is to be understood that the methods of the present invention may be separately and independently applied to each of a plurality of inputs of a security device.

Manual interface 50 may be used by the user to alter the masks such that sub-inputs may be added or removed dynamically. Particularly, interface 50 may be used to add a mask when a sub-input has been removed, and delete a mask when a sub-input is added.

The present invention has been described herein in connection with wireless security devices. However, it is to be understood that many aspects of the present invention are equally applicable to conventional, hard-wired security devices.

While this invention has been described as having an exemplary design, the present invention may be further modified within the spirit and scope of this disclosure. This application is therefore intended to cover any variations, uses, or adaptations of the invention using its general principles.

What is claimed is:

1. A method of operating a security system, said method comprising the steps of:

activating a security device;

transmitting a first status report from said device in response to said activating step, the first status report automatically being indicative of an input of said security device being in at least one of an alarm condition and a trouble condition;

transmitting a second status report from said device after the first status report has been transmitted, the second status report being indicative of an actual status of the input of said security device;

determining whether the second status report indicates an absence of both said alarm condition and said trouble condition of said input of said security device;

transmitting a third status report from said device after the second status report has been transmitted, the third status report being indicative of the input of said security device actually being in at least one of said alarm condition and said trouble condition; and issuing at least one of an alarm and a trouble warning in response to the third status report only if it was determined that the second status report indicated an absence of both an alarm condition and a trouble condition of said input of said security device.

2. The method of claim 1 wherein a plurality of the second status reports are periodically transmitted, the method comprising the further steps of:

transmitting an identification signal from said security device in response to the activating step; and in response to the transmitting of the identification signal, transmitting instructions to said security device, the instructions instructing the security device how often to transmit the second status reports.

3. The method of claim 2 wherein timing of the issuance of the at least one of an alarm and a trouble warning depends upon a type of the security device as indicated by the identification signal.

4. The method of claim 1 wherein said security device comprises a wireless security device.

5. The method of claim 1 wherein said activating step includes actuation by a human installer.

6. The method of claim 1 wherein the first and second status reports are transmitted in a testing mode and the third status report is transmitted in an operational mode.

7. The method of claim 1 wherein said security device includes a plurality of inputs, said steps of claim 1 being repeated for each of the inputs independently.

8. A security system comprising:

at least one security device including an input, said security device being configured to:

transmit a first status report in response to being activated into a testing mode;

transmit a second status report from said device after the first status report has been transmitted and while said security device is still in the testing mode, the second status report being indicative of a status of said input of said security device;

switch into an operational mode; and transmit a third status report after the second status report has been transmitted and while in the operational mode, the third status report being indicative of said input of said security device being in at least one of an alarm condition and a trouble condition; and a system controller configured to:

receive the first, second and third status reports;

determine whether the first status report indicates a different status than the status indicated by the second status report; and issue at least one of an alarm and a trouble warning in response to the third status report only if the first status report indicates a different status than the status indicated by the second status report.

9. The system of claim 8 wherein said input comprises a battery backup input, the at least one of an alarm and a trouble warning comprising a warning of an absence of battery backup.

10. The system of claim 8 wherein said system controller is configured to issue said at least one of an alarm and a trouble warning in response to the third status report only if it is determined that the second status report indicates an absence of both an alarm condition and a trouble condition of said input of said security device.

11. The system of claim 8 wherein said security device comprises a wireless security device.

12. The system of claim 8 wherein said security device is configured to be activated by a human installer.

13. The system of claim 8 wherein the input of said security device comprises a first of two inputs of said security device, the first input being connected to a contact, the second input being open-circuited, a plurality of second input status reports being transmitted from said device, each of the second input status reports being indicative of a trouble condition.

14. The system of claim 8 wherein said security device includes a plurality of inputs, said security device being configured to transmit the first, second and third status reports for each of the inputs independently, said system controller being configured to issue said at least one of an alarm and a trouble warning depending upon the status reports corresponding to each of the inputs.

15. A method of operating a security system, said method comprising the steps of:

activating a security device;

transmitting a first status report from said device in response to said activating step, said first status report indicating a fault condition of an input of said security device regardless of whether the fault condition exists;

transmitting a second status report from said device after the first status report has been transmitted, the second status report being indicative of an actual status of said input of said security device;

transmitting a third status report from said device after the second status report has been transmitted, the third status report being indicative of said input of said security device being in an actual fault condition; and issuing a fault warning in response to the third status report only if the second status report is indicative of an absence of said fault condition of said input of said security device.

16. The method of claim 15 wherein said fault warning comprises at least one of an alarm and a trouble warning.

17. The method of claim 15 wherein said security device comprises a wireless security device.

18. The method of claim 15 wherein said activating step includes actuation by a human installer.

19. The method of claim 15 wherein the first and second status reports are transmitted in a testing mode and the third status report is transmitted in an operational mode.

20. The method of claim 15 wherein said security device includes a plurality of inputs, said steps of claim 15 being repeated for each of the inputs independently.

* * * * *